US011073024B2

(12) United States Patent
Perron et al.

(10) Patent No.: US 11,073,024 B2
(45) Date of Patent: Jul. 27, 2021

(54) SHAPE RECESSED SURFACE COOLING AIR FEED HOLE BLOCKAGE PREVENTER FOR A GAS TURBINE ENGINE

(71) Applicant: United Technologies Corporation, Farmington, CT (US)

(72) Inventors: Christopher Perron, Tolland, CT (US); Justin M. Aniello, Ellington, CT (US); Shawn M. McMahon, West Hartford, CT (US); Mohamed Hassan, Palm City, FL (US); Ricardo Trindade, Mansfield, CT (US); Steven Bruce Gautschi, Milton, MA (US); David Barger, East Hartford, CT (US); Brett Alan Bartling, Monroe, CT (US); Nicholas J. Madonna, North Haven, CT (US); Robin Prenter, Avon, CT (US); Ryan Lundgreen, Granby, CT (US); Christopher Cosher, Vernon, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 158 days.

(21) Appl. No.: 16/220,396

(22) Filed: Dec. 14, 2018

(65) Prior Publication Data

US 2020/0190993 A1 Jun. 18, 2020

(51) Int. Cl.
*F01D 5/18* (2006.01)
*F01D 9/04* (2006.01)
(Continued)

(52) U.S. Cl.
CPC ..... *F01D 5/187* (2013.01); *F01D 9/041* (2013.01); *F01D 9/042* (2013.01);
(Continued)

(58) Field of Classification Search
CPC ..... F01D 5/187; F01D 25/12; F01D 25/246; F01D 11/08; F01D 9/065; F01D 9/041;
(Continued)

(56) References Cited

U.S. PATENT DOCUMENTS 3,918,835 A 11/1975 Yamarik et al.
4,820,123 A 4/1989 Hall
(Continued)

FOREIGN PATENT DOCUMENTS

WO 2015030926 A1 3/2015

OTHER PUBLICATIONS

European Search Report dated May 15, 2020 issued for corresponding European Patent Application No. 19215954.9.
(Continued)

*Primary Examiner* — J. Todd Newton
*Assistant Examiner* — Eric J Zamora Alvarez
(74) *Attorney, Agent, or Firm* — Bachman & LaPointe, P.C.

(57) ABSTRACT

A vane ring for a gas turbine engine component includes a multiple of vanes that extend between an inner vane platform and an outer vane platform, each of the multiple of vanes contains an airfoil cooling circuit that receives cooing airflow through a feed passage located in the outer vane platform and an extension from the outer vane platform, the extension comprises a metering passage in communication with the feed passage.

8 Claims, 13 Drawing Sheets

(51) Int. Cl.
*F01D 25/12* (2006.01)
*F01D 25/14* (2006.01)
*F01D 25/24* (2006.01)

(52) U.S. Cl.
CPC ..... *F05D 2240/12* (2013.01); *F05D 2240/81* (2013.01); *F05D 2260/201* (2013.01)

(58) Field of Classification Search
CPC .. F01D 9/042; F05D 2240/12; F05D 2240/81; F05D 2260/201; F05D 2240/11; F05D 2260/607; F05D 2260/202
See application file for complete search history.

(56) References Cited

U.S. PATENT DOCUMENTS

| | | | |
|---|---|---|---|
| 5,062,768 | A | 11/1991 | Marriage |
| 6,238,183 | B1 | 5/2001 | Williamson et al. |
| 6,343,911 | B1 | 2/2002 | Burdgick |
| 7,052,233 | B2 | 5/2006 | Fried et al. |
| 8,961,108 | B2 | 2/2015 | Bergman et al. |
| 9,151,164 | B2 * | 10/2015 | Tardif ..... F01D 5/187 |
| 9,341,069 | B2 | 5/2016 | Valiente et al. |
| 2005/0084371 | A1 | 4/2005 | Fried et al. |
| 2007/0048122 | A1 | 3/2007 | Van Suetendael, IV et al. |
| 2008/0279695 | A1 | 11/2008 | Abdel-Messeh et al. |
| 2011/0211946 | A1 | 9/2011 | Burdgick et al. |
| 2013/0136599 | A1 | 5/2013 | Harding |
| 2013/0266416 | A1 | 10/2013 | Bergman et al. |
| 2017/0002671 | A1 | 1/2017 | Waite et al. |
| 2017/0234144 | A1 | 8/2017 | Mugglestone |
| 2017/0335707 | A1 | 11/2017 | Galle |
| 2018/0230836 | A1 | 8/2018 | Tibbott et al. |

OTHER PUBLICATIONS

European Search Report dated May 19, 2020 issued for corresponding European Patent Application No. 19215810.3.
European Search Report dated May 15, 2020 issued for corresponding European Patent Application No. 19215941.6.
U.S. Office Action dated May 15, 2020 issued for corresponding U.S. Appl. No. 16/220,398.
U.S. Final Office Action dated Oct. 26, 2020 issued for corresponding U.S. Appl. No. 16/220,398.
U.S. Non-Final Office Action dated Oct. 7, 2020 issued for corresponding U.S. Appl. No. 16/220,400.

* cited by examiner

SHAPE RECESSED SURFACE COOLING AIR FEED HOLE BLOCKAGE PREVENTER FOR A GAS TURBINE ENGINE

BACKGROUND

The present disclosure relates to a gas turbine engine and, more particularly, to the protection of turbine vanes from particulate blockage of airfoil cooling circuits.

Gas turbine engines typically include a compressor section to pressurize airflow, a combustor section to burn a hydrocarbon fuel in the presence of the pressurized air, and a turbine section to extract energy from the resultant combustion gases. The combustion gases commonly exceed 2000 degrees F. (1093 degrees C.).

Cooling of engine components such as the high pressure turbine vane may be complicated by the presence of entrained particulates in the secondary cooling air that are carried through the engine. During engine operation a single point feed passage to each airfoil cooling circuit may be prone to blockage by foreign object particles. If these single source feed apertures become blocked, the associated downstream airfoil cooling circuit is starved of cooling air which may result in airfoil distress.

SUMMARY

A vane ring for a gas turbine engine component according to one disclosed non-limiting embodiment of the present disclosure includes a multiple of vanes that extend between the inner vane platform and the outer vane platform, each of the multiple of vanes contains an airfoil cooling circuit that receives cooing airflow through a respective one of a multiple of feed passages; a multiple of metering passages in the outer vane platform, each of the multiple of metering passages in communication with one of the multiple of feed passages; and a multiple of secondary passages recessed in the outer vane platform, each of the multiple of secondary passages in communication with a respective one of the multiple of metering passages.

A further embodiment of any of the foregoing embodiments of the present disclosure includes that the secondary passage is a slot.

A further embodiment of any of the foregoing embodiments of the present disclosure includes that the secondary passage has a diameter that is equivalent to the metering passage diameter.

A further embodiment of any of the foregoing embodiments of the present disclosure includes that the secondary passage is of a cross-sectional area equivalent to an entrance area of the metering passage.

A further embodiment of any of the foregoing embodiments of the present disclosure includes that the cross-sectional area of the metering passage is circular.

A further embodiment of any of the foregoing embodiments of the present disclosure includes that the multiple of metering passages and the multiple of secondary passages are located within a hooked rail of the outer vane platform.

A further embodiment of any of the foregoing embodiments of the present disclosure includes that the metering passage and the secondary passage are formed in a surface transverse to the axis.

A further embodiment of any of the foregoing embodiments of the present disclosure includes that the cooling airflow is received in a plenum to scrub along the surface.

A vane ring for a gas turbine engine component according to one disclosed non-limiting embodiment of the present disclosure includes an inner vane platform around an axis; an outer vane platform around the axis; a multiple of vanes that extend between the inner vane platform and the outer vane platform, each of the multiple of vanes contains an airfoil cooling circuit that receives cooing airflow through a respective one of a multiple of feed passages; a hooked rail that extends from the outer vane platform; and a multiple of metering passages in the hooked rail, each of the multiple of metering passages in communication with one of the multiple of feed passages; and a multiple of secondary passages recessed in the hooked rail, each of the multiple of secondary passages in communication with the respective one of the multiple of metering passages.

A further embodiment of any of the foregoing embodiments of the present disclosure includes that teach of the multiple of the metering passages and each of the multiple of secondary passages are formed in a surface transverse to the axis.

A further embodiment of any of the foregoing embodiments of the present disclosure includes that the vane ring is in a second turbine stage.

A further embodiment of any of the foregoing embodiments of the present disclosure includes that the vane ring is in a second turbine stage.

A further embodiment of any of the foregoing embodiments of the present disclosure includes that the secondary passage is a slot.

A further embodiment of any of the foregoing embodiments of the present disclosure includes that the secondary passage diameter is equivalent to the metering passage diameter.

A further embodiment of any of the foregoing embodiments of the present disclosure includes that the secondary passage is of a area equivalent to an input area of the metering passage.

A further embodiment of any of the foregoing embodiments of the present disclosure includes that the metering passage is circular.

A method of communicating airflow into an airfoil cooling circuit of each of a multiple of vanes though a respective feed passage of a gas turbine engine component, the method according to one disclosed non-limiting embodiment of the present disclosure includes flowing a cooling airflow through an entrance to a secondary passage to a metering passage in communication with the feed passage from a surface of a hooked rail to an airfoil cooling circuit for each of the multiple of vanes.

A further embodiment of any of the foregoing embodiments of the present disclosure includes that the airflow scrubs along the surface.

A further embodiment of any of the foregoing embodiments of the present disclosure includes that the airflow is a cooling airflow.

A further embodiment of any of the foregoing embodiments of the present disclosure includes that the secondary passage is a transverse slot to the metering passage.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
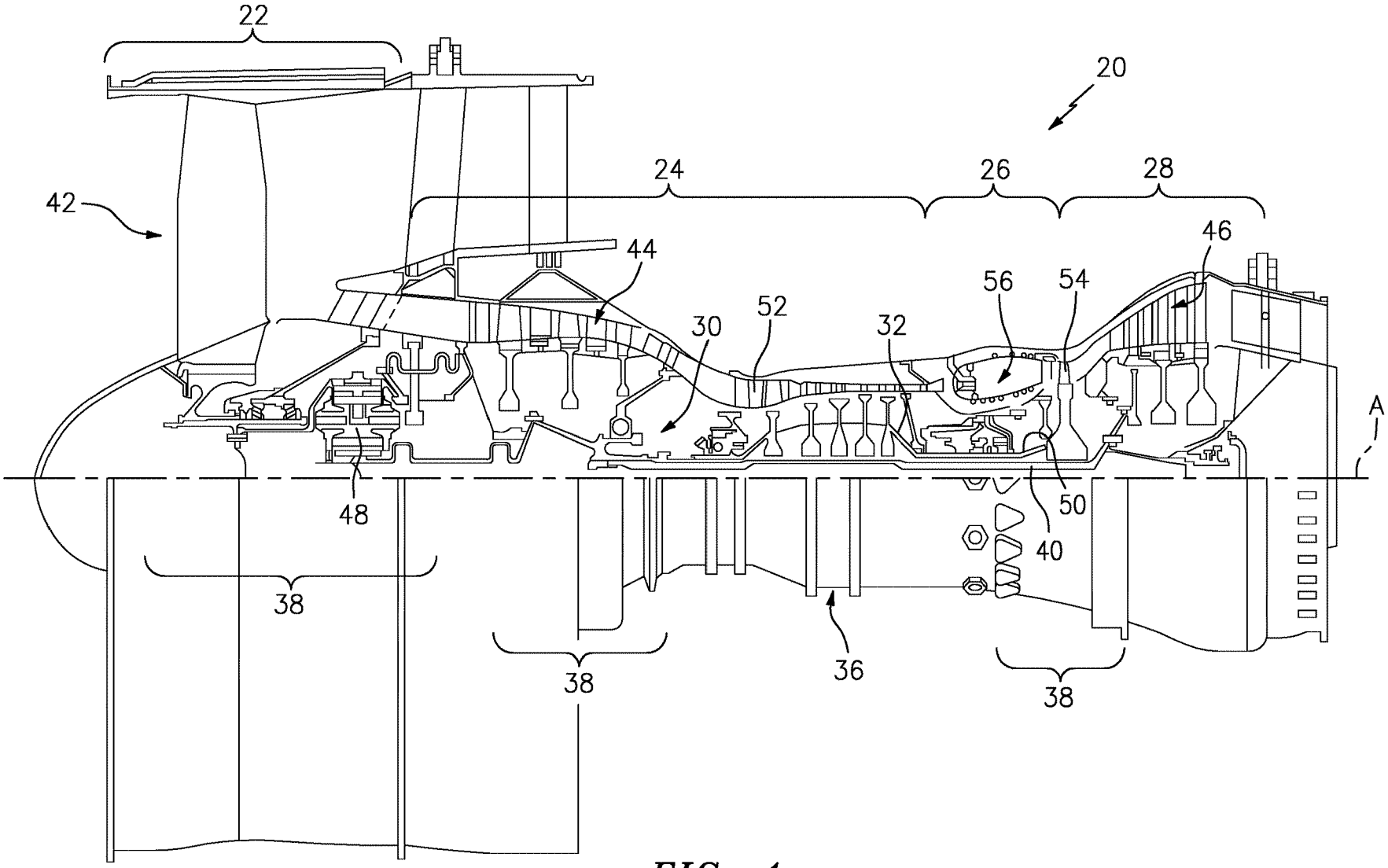
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, the concepts described herein may be applied to other turbine engine architectures such as turbojets, turboshafts, and three-spool (plus fan) turbofans.

The engine 20 generally includes a low spool 30 and a high spool 32 mounted for rotation about an engine central longitudinal axis A relative to an engine case structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then the combustion gasses are expanded over the HPT 54 and the LPT 46. The turbines 46, 54 rotationally drive the respective low spool 30 and high spool 32 in response to the expansion. The main engine shafts 40, 50 are supported at a plurality of points by bearing assemblies 38 within the engine case structure 36.

Figure 2:
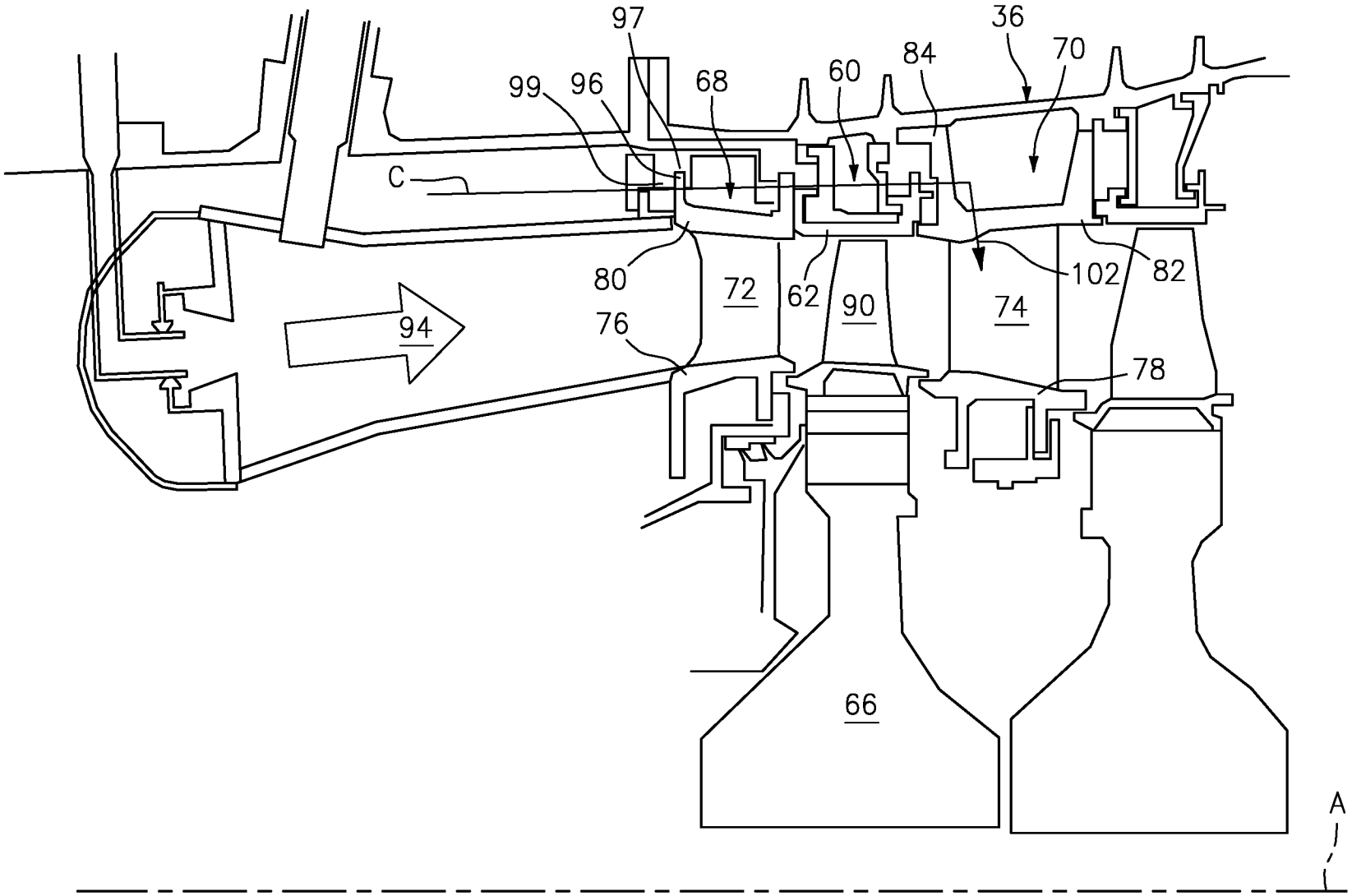
FIG. 2 is an schematic cross-section of an engine turbine section including a feed passage arrangement for vane ring.

With reference to FIG. 2, an enlarged schematic view of a portion of the turbine section 28 is shown by way of example; however, other engine sections will also benefit herefrom. A full ring shroud assembly 60 within the engine case structure 36 supports a blade outer air seal (BOAS) assembly 62. The blade outer air seal (BOAS) assembly 62 contains a multiple of circumferentially distributed BOAS 64 proximate to a rotor assembly 66. The full ring shroud assembly 60 and the blade outer air seal (BOAS) assembly 62 are axially disposed between a forward stationary vane ring 68 and an aft stationary vane ring 70. Each vane ring 68, 70 includes an array of vanes 72, 74 that extend between a respective inner vane platform 76, 78 and an outer vane platform 80, 82. The inner vane platforms 76, 78 and the outer vane platforms 80, 82 attach their respective vane ring 68, 70 to the engine case structure 36.

The blade outer air seal (BOAS) assembly 62 is affixed to the engine case structure 36 to form an annular chamber between the blade outer air seal (BOAS) assembly 62 and the engine case structure 36. The blade outer air seal (BOAS) assembly 62 bounds the working medium combustion gas flow in a primary flow path 94. The vane rings 68, 70 align the flow of the working medium combustion gas flow while the rotor blades 90 collect the energy of the working medium combustion gas flow to drive the turbine section 28 which in turn drives the compressor section 24.

The forward stationary vane ring 68 is mounted to the engine case structure 36 upstream of the blade outer air seal (BOAS) assembly 62 by a vane support 96. The vane support 96, for example, may include a rail 97 that extends from the outer vane platform 80 that is fastened to the engine case structure 36. The rail 97 includes a multitude of apertures 99 spaced therearound to communicate cooling air "C" into the vanes 72 as well as downstream thereof. Cooling air "C", also referred to as secondary airflow, often contains foreign object particulates (such as sand). As only a specific quantity of cooling air "C" is required, the cooling air "C" is usually metered to minimally affect engine efficiency.

Figure 3:
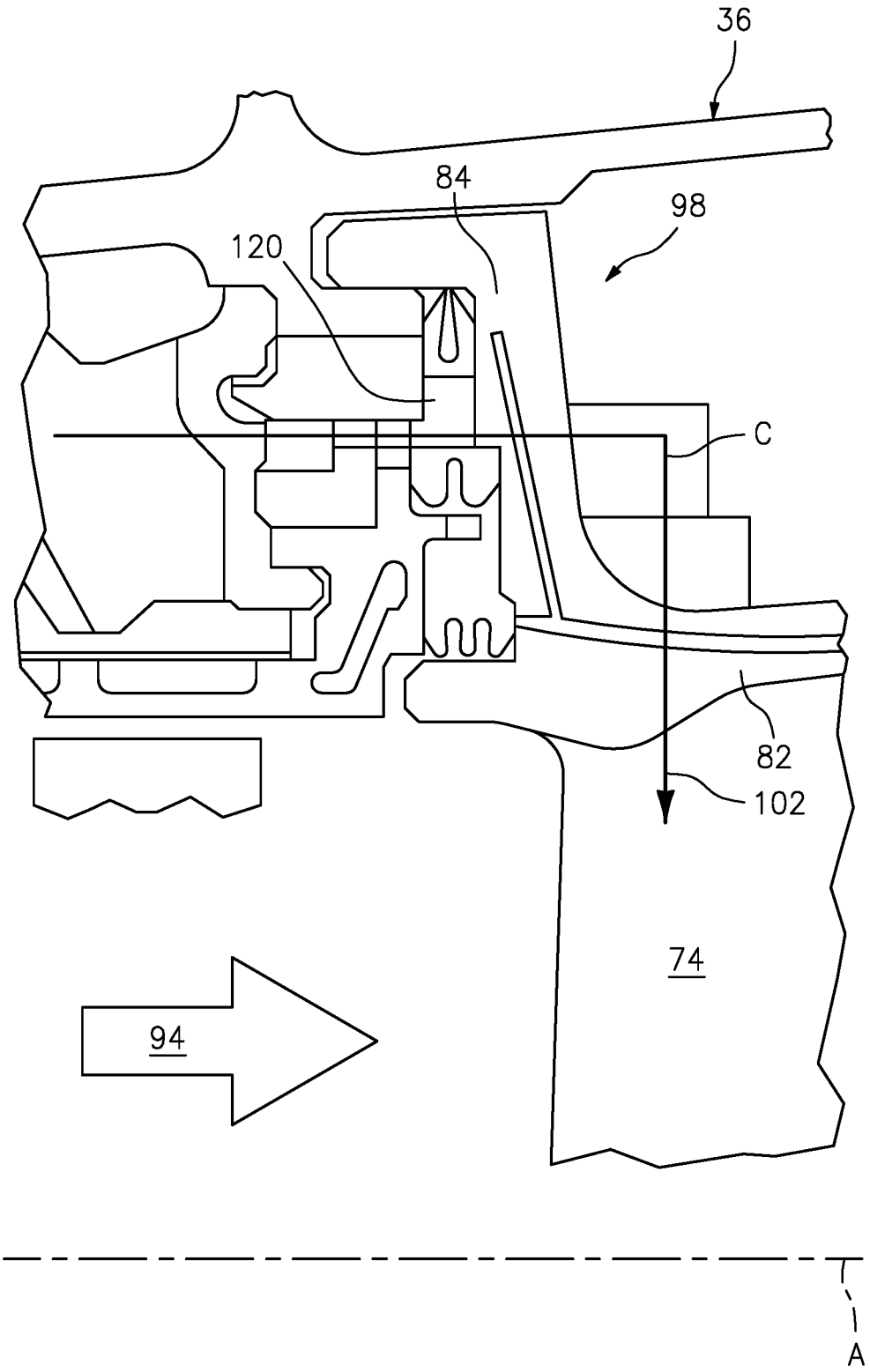
FIG. 3 is an enlarged schematic cross-section of an engine turbine section including a feed passage arrangement for vane ring.

The aft stationary vane ring 70 is mounted to the engine case structure 36 downstream of the blade outer air seal (BOAS) assembly 62 by a vane support 98. The vane support 98 extends from the outer vane platform 82 and may include an annular hooked rail 84 (also shown in FIG. 3) that engages the engine case structure 36.

Figure 4:
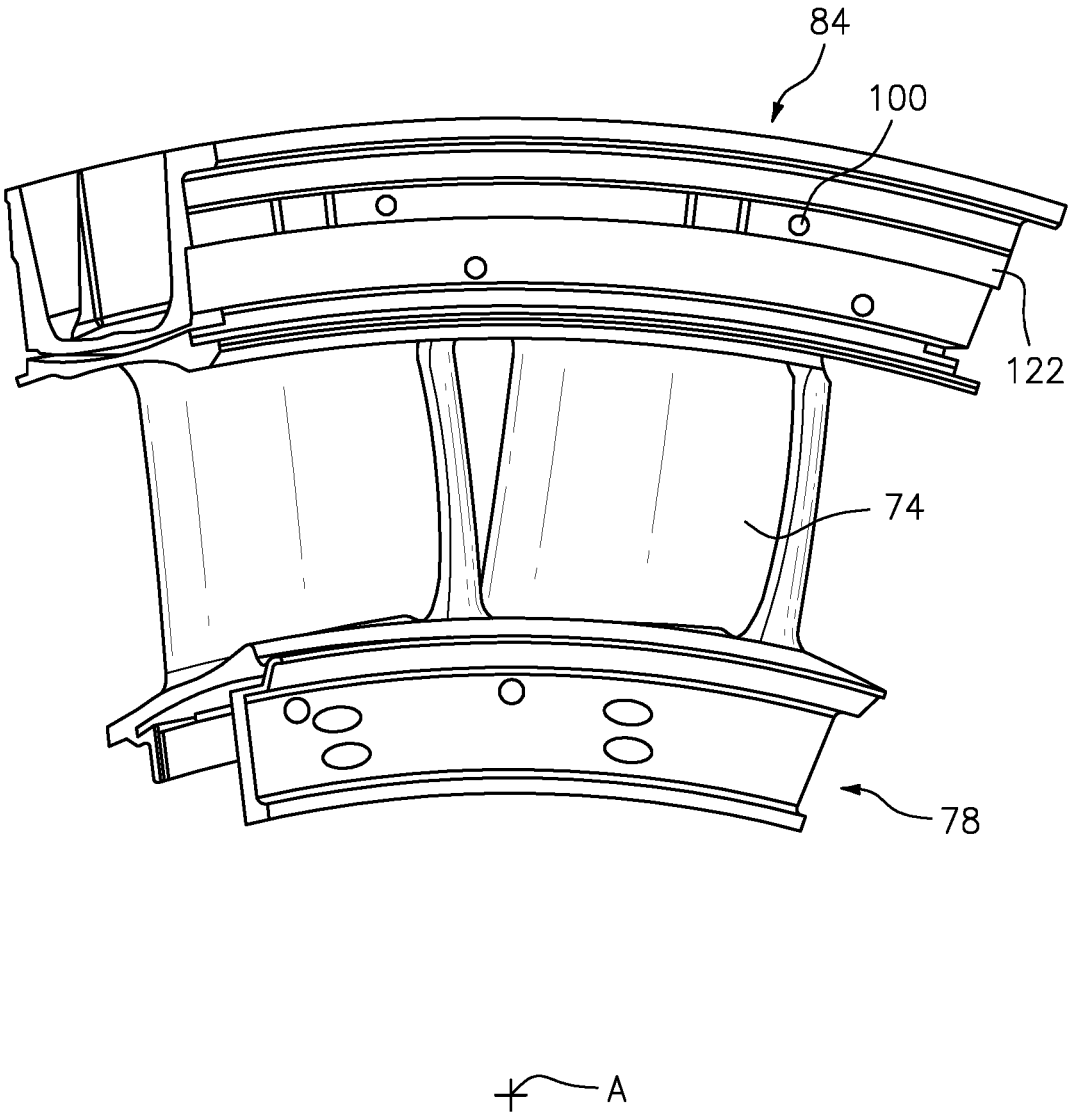
FIG. 4 is a perspective view of the feed passage arrangement within an example second stage vane ring doublet.

The annular hooked rail 84 includes a feed passage 100 (also shown in FIG. 3 and FIG. 4) for each vane 74. The feed passage 100 supplies the cooling air "C" to an airfoil cooling circuit 102 distributed within the respective vane 74. That is, each vane 74 receives cooling air "C" from one respective feed passage 100 (FIG. 4) that feeds the airfoil cooling circuit 102. In one example, the feed passage is about 0.1 inches (2.5 mm) in diameter.

Figure 5:
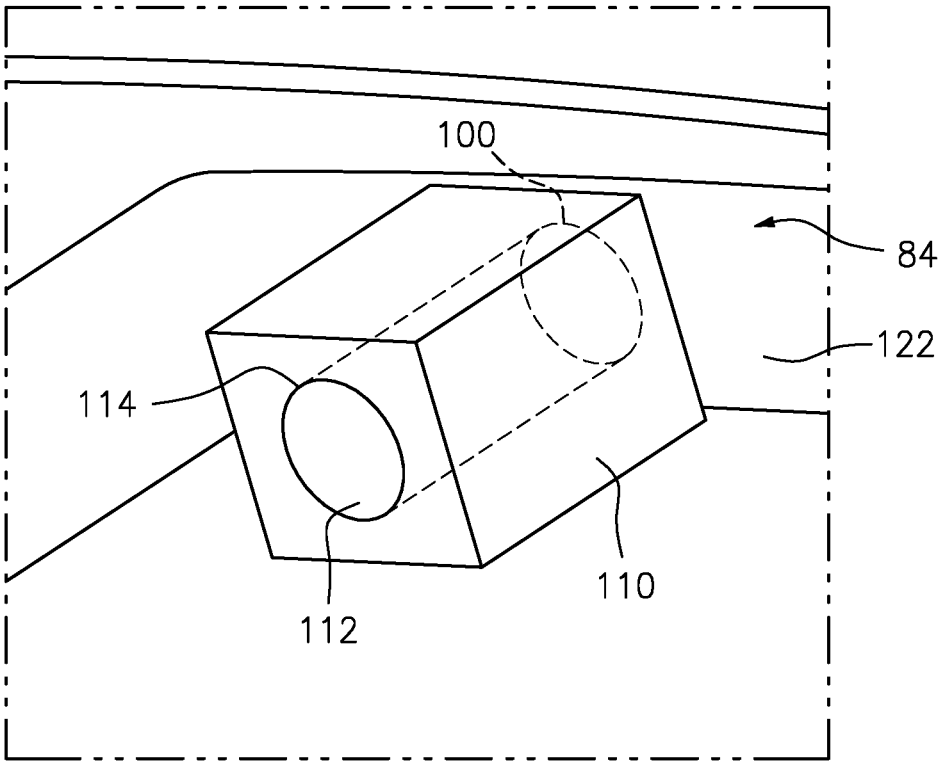
FIG. 5 is a perspective view of the feed passage according to another disclosed non-limiting embodiment.

With reference to FIG. 5, one disclosed embodiment of the feed passage 100 includes an extension 110 with a metering passage 112 in communication with the feed passage 100. The extension 110 projects from a surface 122 of the annular hooked rail 84. The surface 122 is an annular face transverse to the engine axis A. In the disclosed embodiment, the extension 110 is generally cubic in shape, however, other shapes such as cylinders, polygons, and others may be utilized. The extension 110 may be a stand-alone feature or, alternatively, an anti-rotation feature for the stationary vane ring 70. The extension 110 may be a cast integral with the outer vane platform 80 or may be separately machined and attached thereto in communication with the feed passage 100. Cooling airflow "C" communicated to the plenum 120 (FIG. 3) generally scrubs along the surface 122 such that foreign object particles therein have a lessened tendency to enter an entrance 114 to the metering passage 112 as the entrance 114 is displaced from the surface 122.

Figure 6:
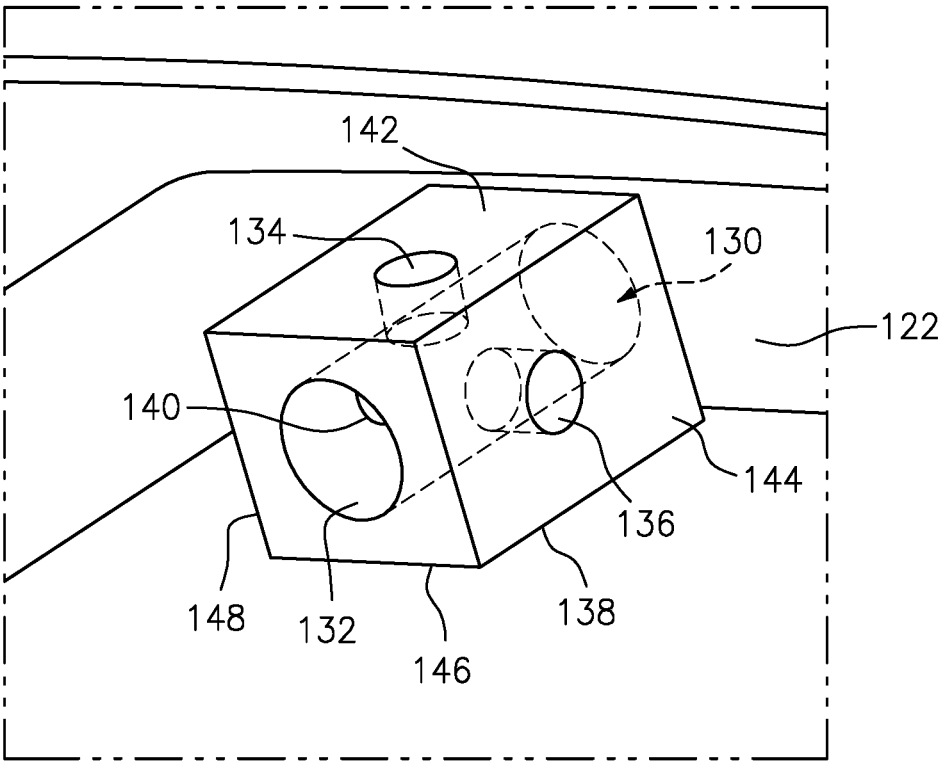
FIG. 6 is a perspective view of the feed passage according to another disclosed non-limiting embodiment.

With reference to FIG. 6, another disclosed embodiment of the feed passage 100 includes an extension 130 with a metering passage 132 and a multiple of secondary passages 134, 136, 138, 140 in each face 142, 144, 146, 148 of the extension 130 transverse to the metering passage 132. The metering passage 132 is sized to meter the flow into the airfoil cooling circuit 102 within the vane 74 such that the secondary passages 134, 136, 138, 140 need not be specifically sized to meter the cooling flow "C".

Cooling airflow within the plenum 120 adjacent the outer vane platform 80, 82 generally scrubs along the surface 122 such that foreign object particles therein have a lessened tendency to enter the metering passage 132 and the secondary passages 134, 136, 138, 140 as they are displaced from the surface 122. Nonetheless, should one passage become blocked, the other passages permit unobstructed flow into the airfoil cooling circuit 102 within the vane 74.

Figure 7:
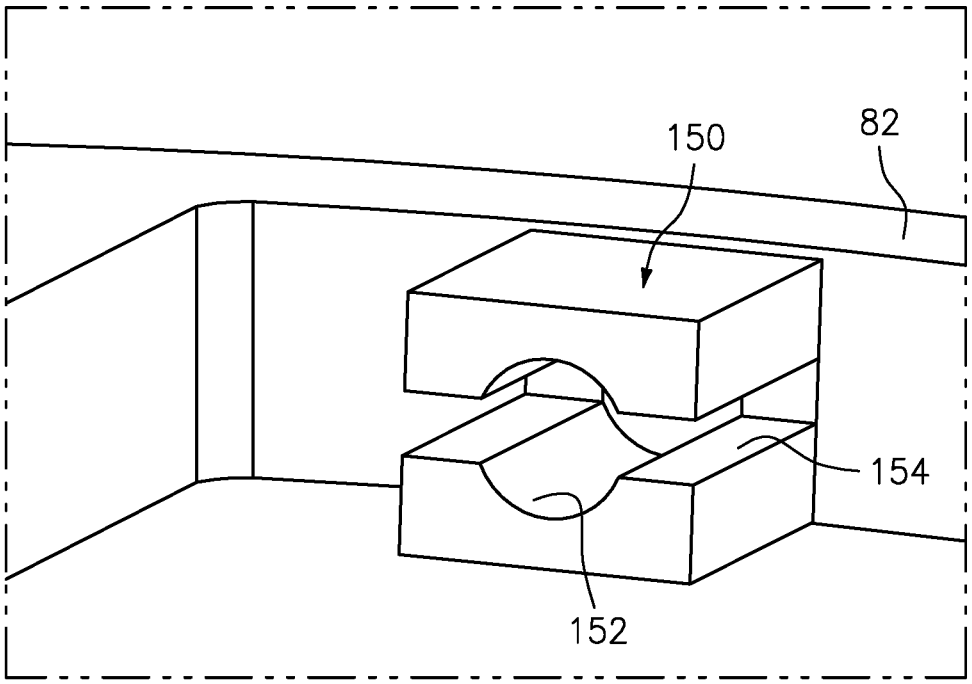
FIG. 7 is a perspective view of the feed passage according to another disclosed non-limiting embodiment.

With reference to FIG. 7, another disclosed embodiment of the feed passage 100 includes an extension 150 with a metering passage 152 and a secondary passage 154 transverse to the metering passage 152. In this example, the secondary passage 154 is a slot transverse to the metering passage 152. If the foreign object particles that scrub along the surface 122 are of a size to block the metering passage 152, the foreign objects will become stuck on the secondary passage 154 and not be allowed to enter the metering passage 152. Additionally if the entrance of the metering passage 152 becomes blocked with a sizeable foreign object, cooling air can still enter the metering passage 152 through the secondary passage 154.

Figure 8:
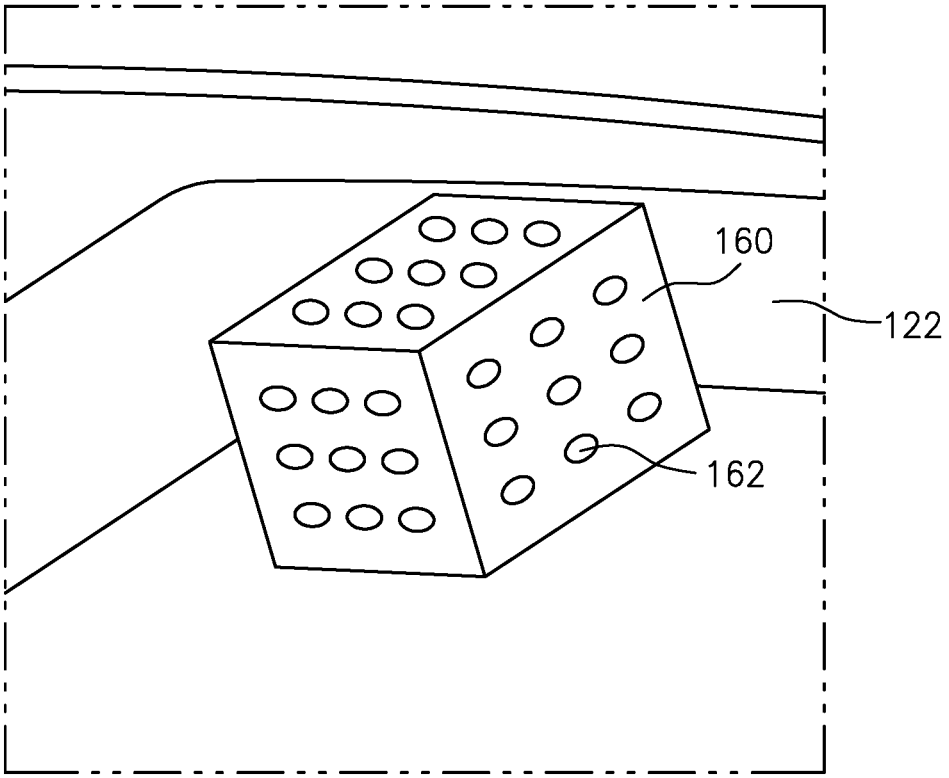
FIG. 8 is a perspective view of the feed passage according to another disclosed non-limiting embodiment.

With reference to FIG. 8, another disclosed embodiment of the feed passage 100 includes an extension 160 with a multiple of secondary passages 162. The extension 160 may be separately machined and attached to the surface 122. In this embodiment the multiple of secondary passages 162 operate to meter the cooling air "C".

Figure 9:
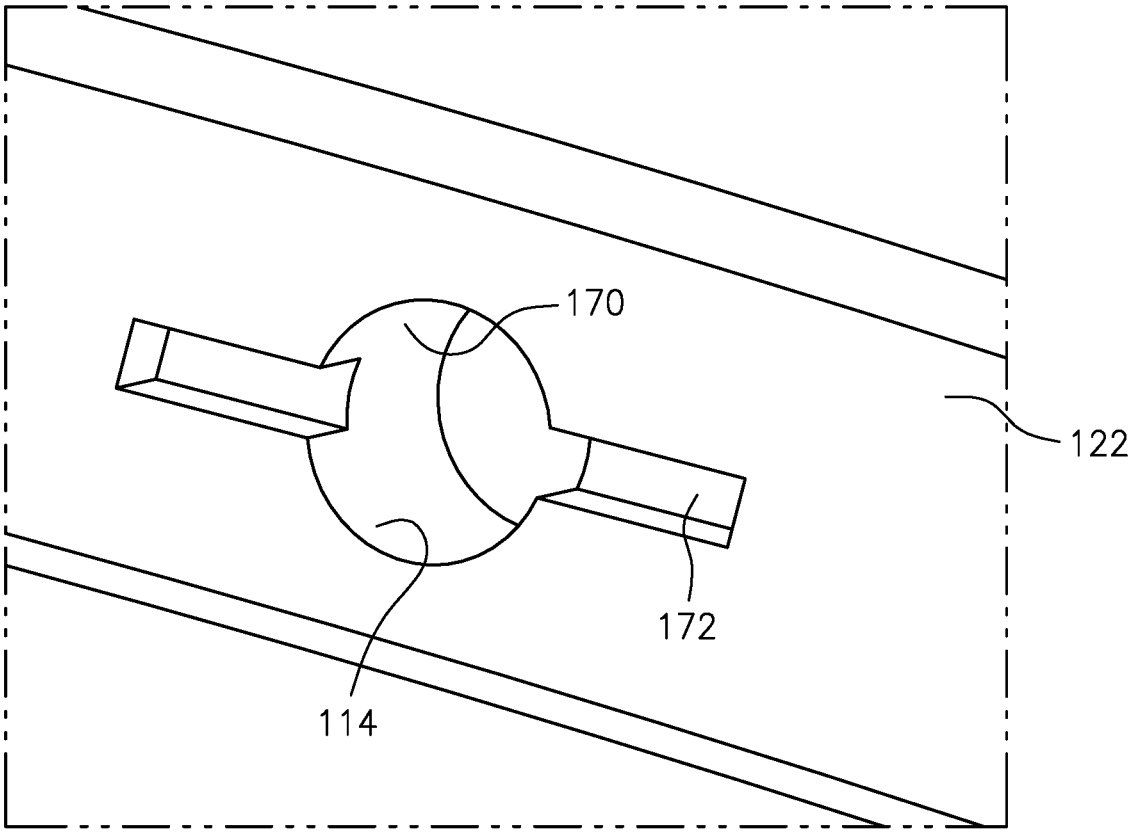
FIG. 9 is a perspective view of the feed passage according to another disclosed non-limiting embodiment.
Figure 10:
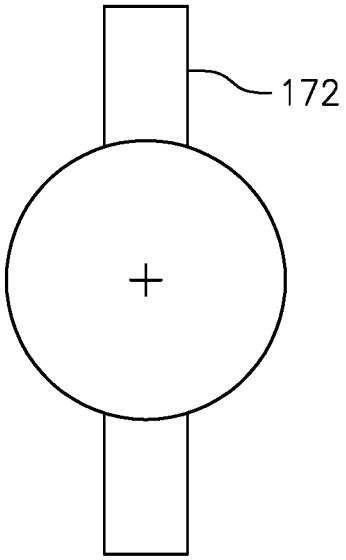
FIG. 10 is a perspective view of the feed passage according to another disclosed non-limiting embodiment.
Figure 11:
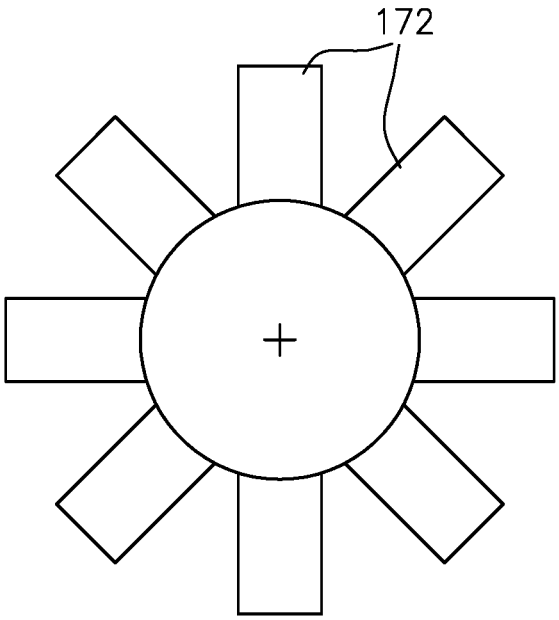
FIG. 11 is a perspective view of the feed passage according to another disclosed non-limiting embodiment.

With reference to FIG. 9, another disclosed embodiment of the feed passage 100 includes a metering passage 170 and a secondary passage 172 transverse to the metering passage 170. In one example, the feed slot 172 provides a recessed area approximately equivalent to an area of the entrance 114 to the metering passage 170. The secondary passage 172, in one example is a slot recessed into the surface 122. Although one slot is illustrated in the disclosed embodiment, any number and orientation of secondary passages 172 (FIG. 10-11) may alternatively be provided. Should the metering passage 170 become blocked, cooling air "C" may readily pass through the secondary passage 172 under the foreign object stuck in the entrance 114 and thereby pass into the feed passage 100.

Figure 12:
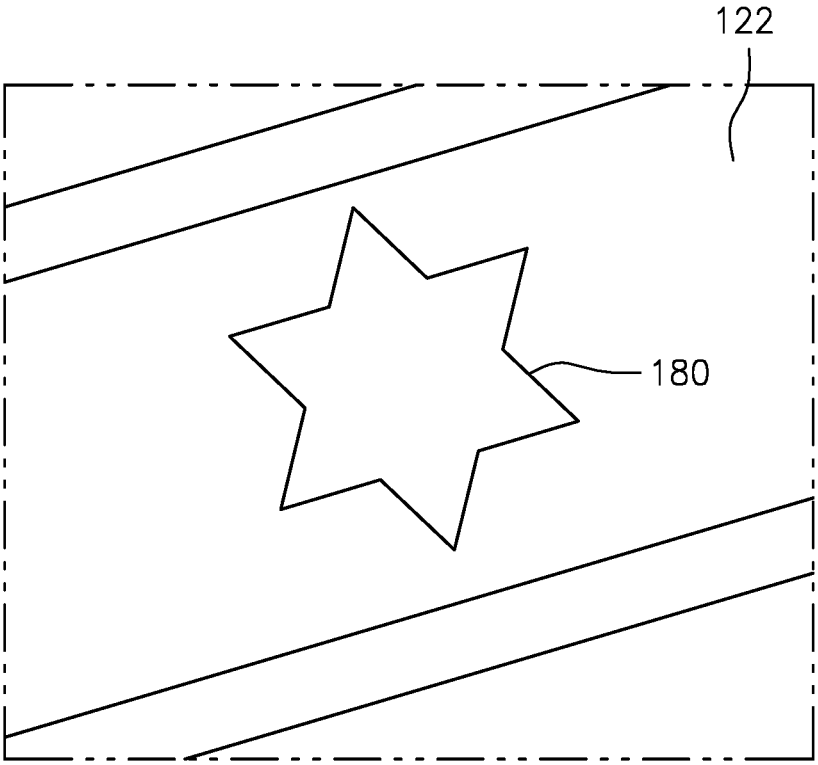
FIG. 12 is a perspective view of the feed passage according to another disclosed non-limiting embodiment.

With reference to FIG. 12, another disclosed embodiment of the feed passage 100 includes a non-circular metering passage 180. The non-circular metering passage 180 is less likely to be completely blocked by foreign object particles in the cooling flow, thus assuring cooling flow "C".

Figure 13:
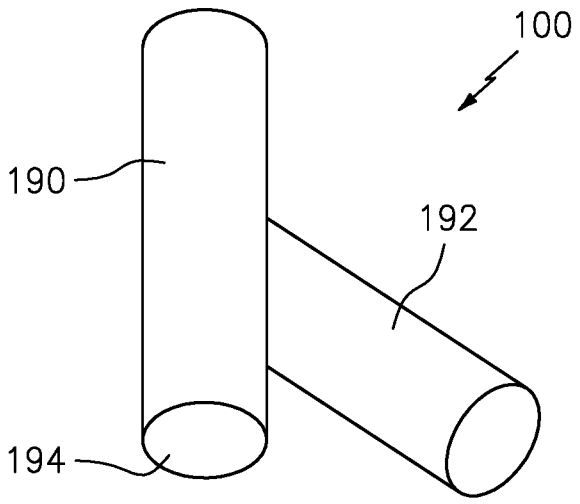
FIG. 13 is a perspective view of the feed passage according to another disclosed non-limiting embodiment.

With reference to FIG. 13, another disclosed embodiment of the feed passage 100 includes a metering passage 190, and a secondary passage 192 that intersects with the metering passage 190. That is, the secondary passage 192 is a branch from the metering passage 190. In one example, the secondary passage 192 forms an angle of about 30 degrees with respect to the metering passage 190. The metering passage 190 may be sized to meter the cooling flow "C" such that the secondary passage 192 need not be specifically sized to meter the cooling flow "C". Should the metering passage 190 become blocked, cooling air may readily pass through the secondary passage 192 then into the metering passage 190 downstream of the entrance 194. The secondary passage 192 may be circumferentially located with respect to the metering passage 190 to minimize ingress of the foreign object particles based on the expected cooling flow adjacent each vane 70.

Figure 14:
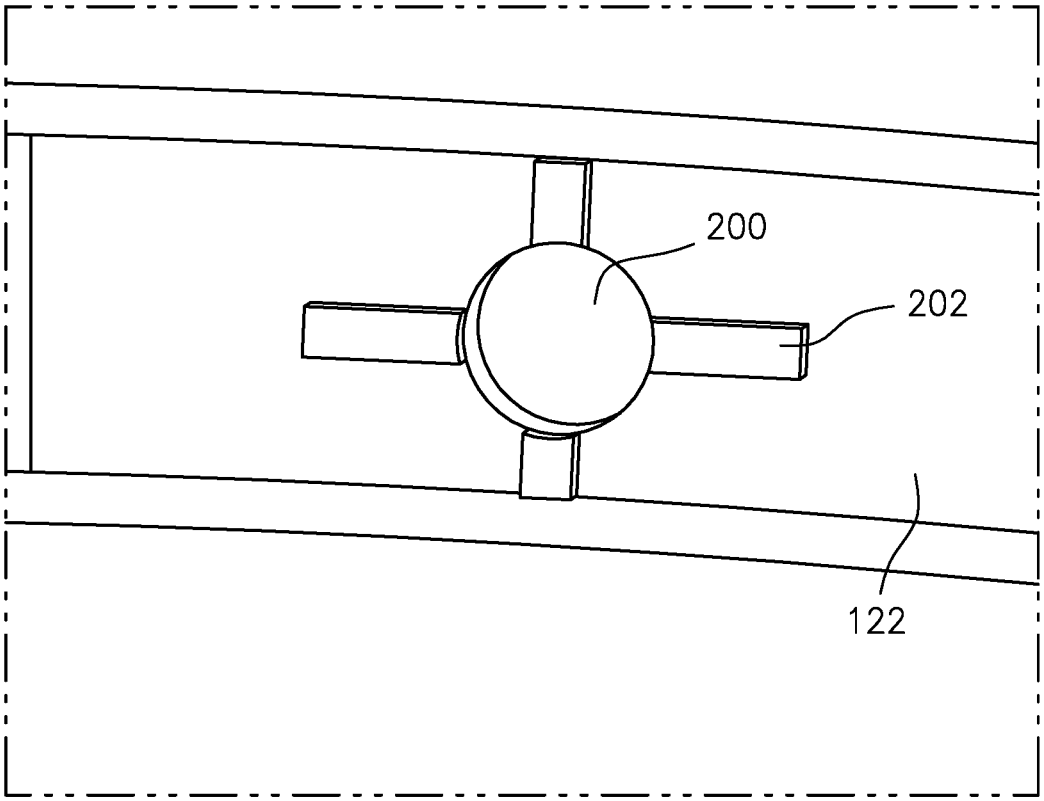
FIG. 14 is a perspective view of the feed passage according to another disclosed non-limiting embodiment.

With reference to FIG. 14, another disclosed embodiment of the feed passage 100 includes a metering passage 200 and a multiple of raised areas 202 that are located around the metering passage 200. The raised areas 202 extend from the surface 122. The multiple of raised areas 202 disrupt the flow and allows the foreign particles to collect outside the metering passage 200 rather than entering. Various shapes may alternatively be provides such as an asterisk shape.

During operation of the engine, cooling flow "C" from the high pressure compressor flows around the combustor and into the first vane cavity 102. This cooling air has particulates entrained in it. These particulates are present in the working medium flow path as ingested from the environment by the engine. The majority of the particulates are very fine in size, thus they are carried through the sections of the engine as the working medium gases flow axially downstream. Should a particle be of a size to block the metering passage, the secondary flow passages necessarily permit communication of at least a portion of the cooling air which significantly reduces the risk of damage to the airfoil and increases component field life.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed:

1. A vane ring for a gas turbine engine component, comprising:

an inner vane platform around an axis;

an outer vane platform around the axis;

a multiple of vanes that extend between the inner vane platform and the outer vane platform, each of the multiple of vanes contains an airfoil cooling circuit that receives cooling airflow through a respective one of a multiple of feed passages;

a multiple of metering passages in the outer vane platform, each of the multiple of metering passages in communication with one of the multiple of feed passages;

a multiple of secondary passages recessed in the outer vane platform, each of the multiple of secondary passages in communication with a respective one of the multiple of metering passages;

a metering passage in the outer vane platform in communication with one of the multiple of feed passages, wherein a cross-sectional area of the metering passage is circular; and a secondary passage recessed into a surface of the outer vane platform transverse and in communication with the metering passage, the secondary passage provides a recessed area equivalent to an area of an entrance to the metering passage, wherein the secondary passage forms a slot.

2. The vane ring as recited in claim 1, wherein the metering passage and the secondary passage are formed in a surface transverse to the axis.

3. The vane ring as recited in claim 2, wherein the cooling airflow is received in a plenum to scrub along the surface.

4. The vane ring as recited in claim 1, wherein the cooling airflow passes through the secondary passage under a foreign object stuck in the entrance to the metering passage and thereby passes into the feed passage.

5. The vane ring as recited in claim 1, wherein the secondary passage recessed in the outer vane platform extends across the circular metering passage.

6. A vane ring for a gas turbine engine component, comprising:

an inner vane platform around an axis;

an outer vane platform around the axis;

a multiple of vanes that extend between the inner vane platform and the outer vane platform, each of the multiple of vanes contains an airfoil cooling circuit that receives cooling airflow through a respective one of a multiple of feed passages;

a hooked rail that extends from the outer vane platform;

a circular metering passage in the hooked rail, the circular metering passage in communication with one of the multiple of feed passages; and a secondary passage that forms a slot recessed into a surface of the hooked rail transverse and in communication with the circular metering passage, the secondary passage provides a recessed area equivalent to an area of an entrance to the metering passage.

7. The vane ring as recited in claim 6, wherein the metering passage and the secondary passage are each formed in a surface transverse to the axis.

8. The vane ring as recited in claim 7, wherein the vane ring is in a second turbine stage.

* * * * *